US009424737B2

(12) United States Patent
Bailey et al.

(10) Patent No.: US 9,424,737 B2
(45) Date of Patent: Aug. 23, 2016

(54) USER MANAGEMENT OF A RESPONSE TO A SYSTEM ALARM EVENT

(71) Applicant: ADT US HOLDINGS, INC., Boca Raton, FL (US)

(72) Inventors: Beth Ann Bailey, Knoxville, TN (US); Travis Meyer, Powell, TN (US)

(73) Assignee: ADT Holdings, Inc., Boca Raton, FL (US)

( * ) Notice: Subject to any disclaimer, the term of this patent is extended or adjusted under 35 U.S.C. 154(b) by 144 days.

(21) Appl. No.: 14/341,156

(22) Filed: Jul. 25, 2014

(65) Prior Publication Data

US 2015/0029020 A1 Jan. 29, 2015

Related U.S. Application Data

(60) Provisional application No. 61/858,701, filed on Jul. 26, 2013.

(51) Int. Cl.
*G08B 23/00* (2006.01)
*G08B 25/00* (2006.01)

(52) U.S. Cl.
CPC ..... *G08B 25/001* (2013.01); *G08B 25/005* (2013.01)

(58) Field of Classification Search
CPC .... G08B 25/001; G08B 25/009; G08B 25/14; G08B 25/005; G08B 13/19684; G08B 13/19697; G08B 19/005; G08B 25/006; G08B 19/00; H04M 11/04; H04M 11/045; H04L 63/0428; H04L 63/08; H04L 67/025; H04L 67/34; H04L 45/3065; H04L 47/125
See application file for complete search history.

(56) References Cited

U.S. PATENT DOCUMENTS

| | | | | |
|---|---|---|---|---|
| 7,746,224 | B2 | 6/2010 | Addy | |
| 7,818,573 | B2 | 10/2010 | Martin et al. | |
| 7,941,182 | B2 | 5/2011 | Ferro et al. | |
| 8,013,730 | B2 | 9/2011 | Oh et al. | |
| 8,368,526 | B2 | 2/2013 | Chalk | |
| 8,494,481 | B1 | 7/2013 | Bacco et al. | |
| 2004/0189460 | A1* | 9/2004 | Heaton | G08B 25/10 340/500 |
| 2005/0030174 | A1 | 2/2005 | Hess | |
| 2005/0253706 | A1* | 11/2005 | Spoltore | G08B 25/008 340/539.14 |
| 2006/0125626 | A1* | 6/2006 | Govindaraj | G08B 25/004 340/531 |
| 2008/0048851 | A1* | 2/2008 | Reyes | G08B 7/06 340/506 |

(Continued)

OTHER PUBLICATIONS

International Search Report and Written Opinion dated Oct. 24, 2014 for International Application Serial No. PCT/US2014/048201, International Filing Date: Jul. 25, 2014, consisting of 13 pages.

*Primary Examiner* — Kerri McNally
*Assistant Examiner* — Renee Dorsey
(74) *Attorney, Agent, or Firm* — Christopher & Weisberg, P.A.

(57) ABSTRACT

A system and method for managing a response to an alarm event for an alarm system monitoring a premises are provided. The premises is associated with at least one user device. The system includes a monitoring device including a processor programmed to: determine whether an alarm event has triggered at the premises, determine whether a user response message associated with the at least one user device has been received, and in response to receiving the user response message, cause an indicator at a remote monitoring center to indicate whether the user wants at least one response action.

20 Claims, 7 Drawing Sheets

(56) References Cited

U.S. PATENT DOCUMENTS

2008/0096531 A1* 4/2008 McQuaide ..... H04L 12/58
455/412.1
2008/0284580 A1* 11/2008 Babich ..... G08B 13/19684
340/502
2008/0300572 A1* 12/2008 Rankers ..... A61B 5/14532
604/504
2009/0083828 A1 3/2009 Romanczyk et al.
2011/0090334 A1* 4/2011 Hicks, III ..... G08B 13/19656
348/143
2013/0049949 A1 2/2013 Blum et al.

* cited by examiner

USER MANAGEMENT OF A RESPONSE TO A SYSTEM ALARM EVENT

CROSS-REFERENCE TO RELATED APPLICATION

This application is related to and claims priority to U.S. Provisional Patent Application Ser. No. 61/858,701, filed Jul. 26, 2013, entitled "CANCELLATION OF SECURITY SYSTEM ALARM EVENT USING TEXT OR EMAIL," the entirety of which is incorporated herein by reference.

STATEMENT REGARDING FEDERALLY SPONSORED RESEARCH OR DEVELOPMENT n/a

FIELD

The invention relates to systems that monitor for alarm events at a premises, and in particular to user management of the response to an alarm event at a premises.

BACKGROUND

The demand for systems that monitor homes and businesses for alarm conditions has continued to grow as more home and business owners seek to protect their premises from various hazards and threats. Examples include intrusion, fire, carbon monoxide and flooding, among others dangers that may be monitored and reported to a monitoring station. When a sensor such as a motion detector is triggered, a representative at a remote monitoring center receives an alarm event code and initiates a response process, including contacting a homeowner or others on a contact list and/or first responders such as local firefighters and/or police to request a dispatch to investigate the event at the premises being monitored.

While these systems provide numerous benefits, there are limitations on the ability of a home or business owner to prevent the initiation of response services when not needed, e.g., in the case of a "false alarm." For example, when an alarm event is triggered, there is typically a short period of time allotted to enter a disarm code into the system (either directly into the system at the premises or via remotely such as via mobile application), which then sends an indication that it has been disarmed back to monitoring center. This disarm event is also an indicator that responder dispatch may not be needed. When an alarm event is first received, a representative from the monitoring center also calls a contact number for property owner to verify whether or not to request response services.

However, if the representative cannot immediately speak with the home or business owner, the representative may not be able to adequately verify the nature of the alarm event within a short window of time, and a request for response services may be initiated to investigate. Similarly, while the user may learn of an alarm event via a system notification, if they are not able to quickly disarm the system at the premises (prompting it to send a "disarm" event that is received by the monitoring center) and/or call the monitoring center representative, response services will have already been initiated by the time the owner disarms the system or verifies to the monitoring center representative, and it may not be possible to prevent emergency response.

These limitations on the ability to prevent an emergency response can result in wasted resources at the monitoring center, unnecessary use of valuable response resources, as well as undue cost to the system owner in fees to the responding municipalities or even fines for a false alarm response.

SUMMARY OF THE INVENTION

The invention advantageously provides a method and system for user management of an alarm event at a premises.

According to one embodiment of the invention, a system for managing response to an alarm event for an alarm system monitoring a premises is provided. The premises is associated with at least one user device. The system includes a monitoring device including a processor programmed to: determine whether an alarm event has triggered at the premises, determine whether a user response message associated with the at least one user device has been received, and in response to receiving the user response message, cause an indicator at a remote monitoring center to indicate whether the user wants at least one response action.

According to another embodiment of this aspect, the at least one response action includes at least one of verifying the alarm event, cancelling the alarm event and having a responder dispatched to the premises. According to another embodiment of this aspect, the processor is further programmed to: determine whether the alarm event has triggered at the premises, and in response to determining the alarm event has triggered, cause transmission of a notification message to the at least one user device associated with the premises being monitored, the notification message indicating the alarm event has been triggered. According to another embodiment of this aspect, the notification message includes alarm event information. According to another embodiment of this aspect, the user response message includes user provided information for a responder dispatched to the premises. The user provided information is associated with the alarm event.

According to another embodiment of this aspect, the processor is further programmed to, in response to receiving the user response message, cause transmission of an update message to at least one other user device associated with the premises. The update message indicates at least one of a plurality of users associated with the premises wants the response action. The update message includes the identity of the user that wants the response action. According to another embodiment of this aspect, if the user response message indicates the user wants a responder dispatched to the premises, the user response message further indicates whether the user has verified the alarm event is genuine.

According to another embodiment of this aspect, a security control unit at the premises is provided and configured to determine whether the alarm event has triggered at the premises, and in response determining the alarm event has triggered, cause transmission of a notification message to the at least one user device. The notification message indicates the alarm event has been triggered. According to another embodiment of this aspect, the security control unit is further configured to determine whether the user response message has been received from the at least one user device, and in response to receiving the response message, forwarding the response message to a remote server. According to another embodiment of this aspect, the security control unit is further configured to cause transmission of an update message to at least one other user device. The update message identifies the user of the at least one user device that wants the response action.

According to one embodiment of the invention, a method for managing response to an alarm event for an alarm system monitoring a premises is provided. A determination is made whether an alarm event has triggered at the premises. A determination is made whether a user response message from the at least one user device has been received. In response to receiving the user response message, an indicator at a remote monitoring center is caused to indicate whether the user wants at least one response action.

According to another embodiment of this aspect, the at least one response action includes at least one of verifying the alarm event, cancelling the alarm event and having a responder dispatched to the premises. According to another embodiment of this aspect, a determination is made whether the alarm event has triggered at the premises. In response to determining the alarm event has triggered, causing transmission of a notification message to the at least one user device associated with the premises being monitored is caused. The notification message indicates the alarm event has been triggered. According to another embodiment of this aspect, a cancellation message is transmitted to a dispatch device associated with at least one dispatcher that is responding to the alarm event.

According to another embodiment of this aspect, in response to receiving the user response message indicating, transmission of an update message to at least one other user device associated with the premises is caused. The update message indicates at least one of a plurality of users associated with the premises wants the response action. The update message includes the identity of the user that wants to cancel the response action. According to another embodiment of this aspect, if the user response message indicates the user wants a responder dispatched to the premises, the user response message further indicates whether the user has verified the alarm event is genuine. According to another embodiment of this aspect, transmission of an update message to at least one other user device is caused. The update message identifies the user of the at least one user device that wants to one of verifying and cancel the response action. According to another embodiment of this aspect, the user response message includes user provided information for a responder dispatched to the premises. The user provided information is associated with the alarm event.

According to another embodiment of the invention, a server for managing response to an alarm event for an alarm system monitoring a premises is provided. The server is associated with a remote monitoring center. The server includes a processor programmed to determine whether the alarm event has triggered at the premises, and in response to determining the alarm event has triggered, cause transmission of a notification message to the at least one user device associated with the premises being monitored. The notification message indicates the alarm event has been triggered. The processor is further programmed to determine whether a user response message from the at least one user device has been received. The user response message indicates the user of the at least one user device wants at least one response action. The processor is further programmed to, in response to receiving the response message, cause an indicator at a remote monitoring center that is servicing the alarm event to be triggered. The triggered indicator indicates whether the user wants at least one response action.

According to another embodiment of this aspect, the processor is further programmed to, in response to receiving the user response message, cause transmission of an update message to at least one other user device associated with the premises. The update message indicates at least one of a plurality of users associated with the premises wants the response action. The update message includes the identity of the user that wants the response action. According to another embodiment of this aspect, if the user response message indicates the user wants to a responder dispatched to the premises. The user response message further indicates whether the user has verified the alarm event is genuine. According to another embodiment of this aspect, the at least one response action includes at least one of verifying the alarm event, cancelling the alarm event and having a responder dispatched to the premises. According to another embodiment of this aspect, the user response message includes user provided information for a responder dispatched to the premises. The user provided information is associated with the alarm event.

BRIEF DESCRIPTION OF THE DRAWINGS

A more complete understanding of the invention, and the attendant advantages and features thereof, will be more readily understood by reference to the following detailed description when considered in conjunction with the accompanying drawings wherein.

DETAILED DESCRIPTION OF THE INVENTION

Figure 1:
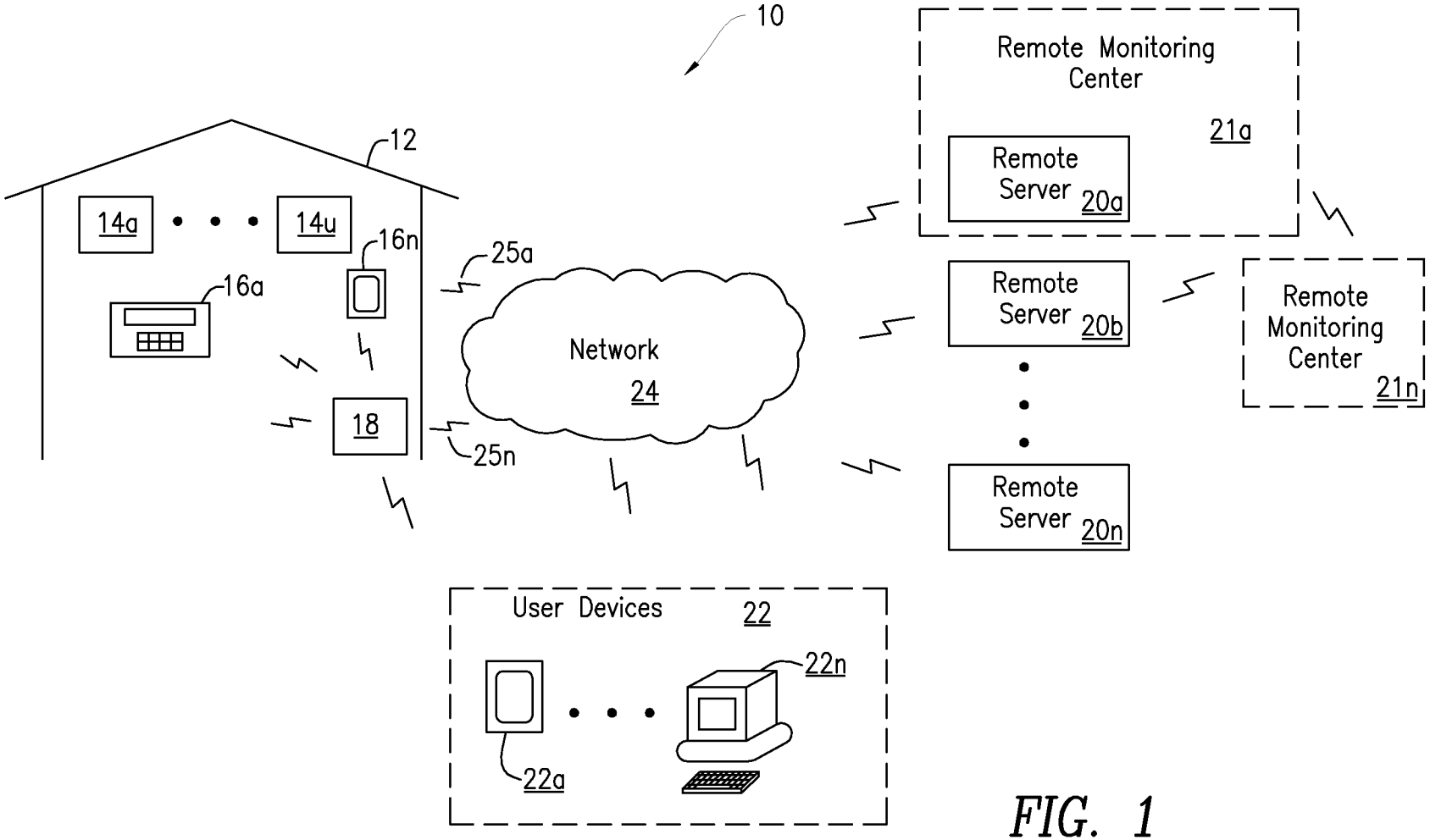
FIG. 1 is a block diagram of a security control system for managing an alarm event in accordance with the principles of the invention.

The invention advantageously provides a system, device and method for managing an alarm event at a premises. Accordingly, the system, device and method components have been represented where appropriate by convention symbols in the drawings, showing only those specific details that are pertinent to understanding the embodiments of the invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

In embodiments described herein, the joining term, "in communication with" and the like, may be used to indicate electrical or data communication, which may be accomplished by physical contact, induction, electromagnetic radiation, radio signaling, infrared signaling or optical signaling, for example. One having ordinary skill in the art will appreciate that multiple components may interoperate and modifications and variations are possible of achieving the electrical and data communication.

Referring now to the drawing figures in which like reference designator refer to like elements there is shown in FIG. 1 a security control system constructed in accordance with the principles of the invention and designated generally as "10." System 10 includes one or more premises 12. Premises 12 includes one or more one or more premises devices 14*a* to 14*n* (collectively referred to as "premises device 14"), one or more interface devices 16*a* to 16*n* (collectively referred to as "interface device 16") and one or more security control units 18. Premises device 14, user interface 16 and security control unit 18 provide an alarm system for monitoring premises 12. The alarm system is configured to be in an armed state or disarm state. When in the armed state, a triggered premises device 14 causes an alarm event to be generated.

System 10 also includes one or more remote servers or monitoring devices 20*a* to 20*n* (collectively referred to as "remote server 20"), one or more user devices 22*a* to 22*n* (collectively referred to as "user device 22") and one or more networks 24. Premises devices 14 may include one or more types of sensors, control and/or image capture devices. For example, the types of sensors may include various life safety related sensors such as motion sensors, fire sensors, carbon monoxide sensors, flooding sensors and contact sensors, among other sensor types that are known in the art. The control devices may include, for example, one or more life style related devices configured to adjust at least one premises setting such as lighting, temperature, energy usage, door lock and power settings, among other settings associated with the premises or devices on the premises. Image capture devices may include digital cameras and/or video cameras, among other image capture devices that are well known in the art. Premises device 14 may communicate with security control unit 18 via wired connection, proprietary wireless communication protocols and may also use Wi-Fi, all of which are known in the art. Those of ordinary skill in the art will also appreciate that various additional sensors and control and/or image capture devices may relate to life safety or life style depending on both what the sensors, control and image capture devices do and how these sensors, control and image devices are used by system 10.

Interface device 16 may be a wireless device that allows a user to communicate with security control unit 18. Interface device 16 may be a wall mounted control panel 16*a*, tablet 16*n*, computer and mobile phone, among other devices that allow a user to interface with security control unit 18. User interface device 16 may communicate at least with security control unit 18 using one or more wireless communication protocols well known to those of ordinary skill in the art. For example, portable control keypad 16*a* may communicate with security control unit 18 via a ZigBee based communication link, e.g., network based on Institute of Electrical and Electronics Engineers (IEEE) 802.15.4 protocols, and/or Z-wave based communication link, or over the premises' local area network, e.g., network based on Institute of Electrical and Electronics Engineers (IEEE) 802.11 protocols.

Security control unit 18 may provide management functions such as power management, premises device management and alarm management, among other functions. In particular, security control unit 18 may manage one or more life safety and life style features. Life safety features may correspond to security system functions and settings associated with premises conditions that may result in life threatening harm to a person such as carbon monoxide detection and intrusion detection. Life style features may correspond to security system functions and settings associated with video capturing devices and non-life threatening conditions of the premises such as lighting and thermostat functions.

Security control unit 18 may communicate with network 24 via one or more communication links 25*a* to 25*n* (collectively referred to as "communication link 25"). In particular, the communications links may be broadband communication links such as a wired cable modem or Ethernet communication link 25*a*, and digital cellular communication link 25*n*, e.g., long term evolution (LTE) based link, among other broadband communication links known in the art. Broadband as used herein may refer to a communication link other than a plain old telephone service (POTS) line. Ethernet communication link 25*a* may be an IEEE 802.3 based communication link. Network 24 may be the Internet, wide area network, local area network, wireless local network and metropolitan area network, among other networks known in the art. Network 24 provides communications between security control unit 18 and remote server 20.

Figure 4:
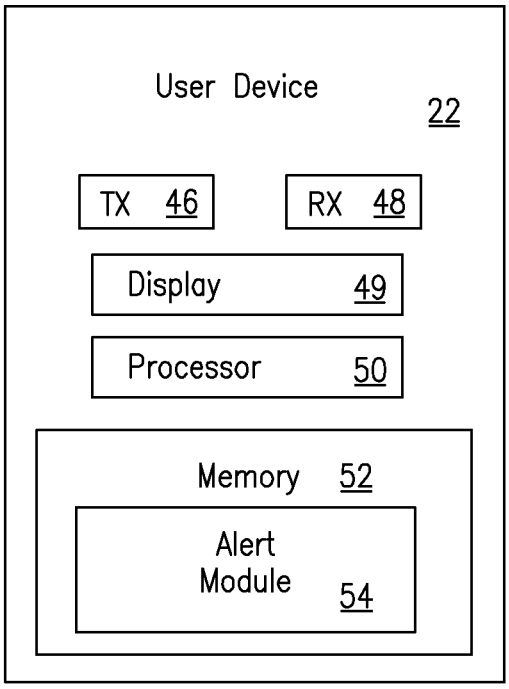
FIG. 4 is a block diagram of a user device in accordance with the principles of the invention.
Figure 7:
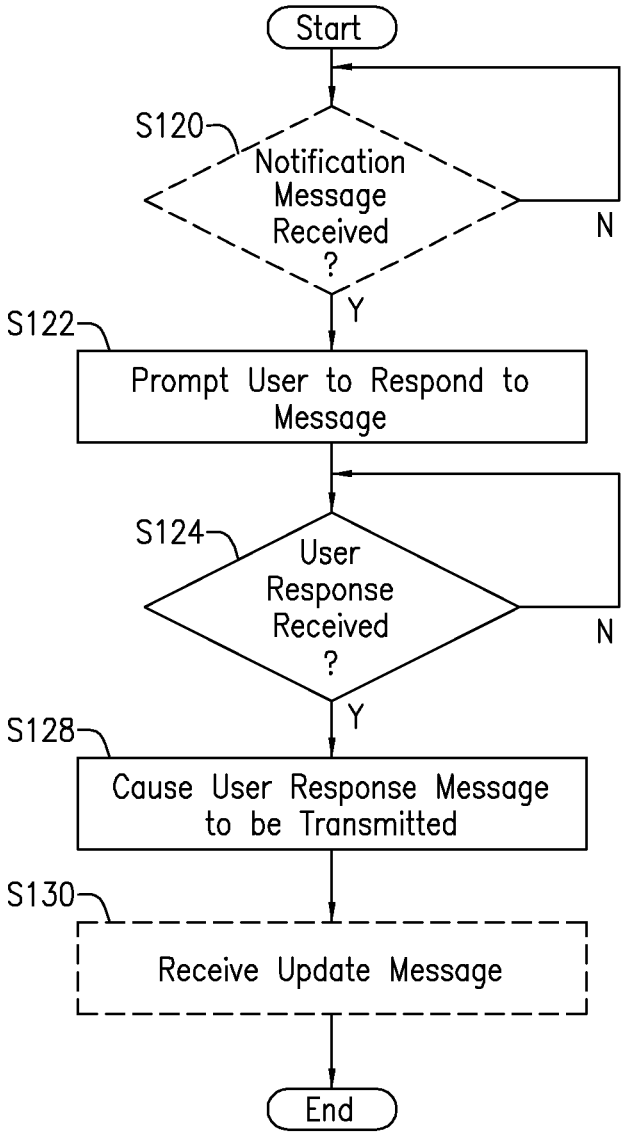
FIG. 7 is a flowchart of an exemplary alert process in accordance with the principles of the invention.

User device 22 may include mobile phone 22*a*, smartphone, personal digital assistant, personal computer 22*n* and tablet, among other devices that allow a user to communicate messages to and/or from remote server 20 and/or security control panel 18 via network 24, as discussed in detail with respect to FIGS. 4 and 7. User device 22 may communicate with remote server 20 via network 24 using one or more wireless communication protocols known in the art. While user device 22 is illustrated as being a separate device from interface device 16, the functionality of user device 22 may be included in interface device 16. For example, a user's cellular phone may provide the functionality of both interface device 16 and user device 22. While user device 22 is illustrated being remote from premises 12, user device 22 can be remote or proximate premises 12.

Figure 3:
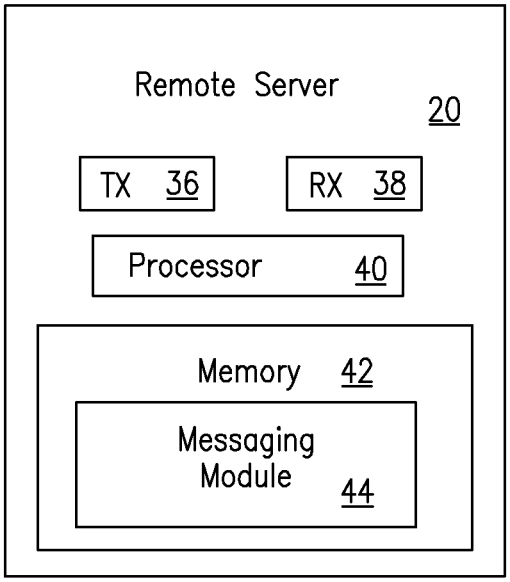
FIG. 3 is a block diagram of a remote server in accordance with the principles of the invention.
Figure 5:
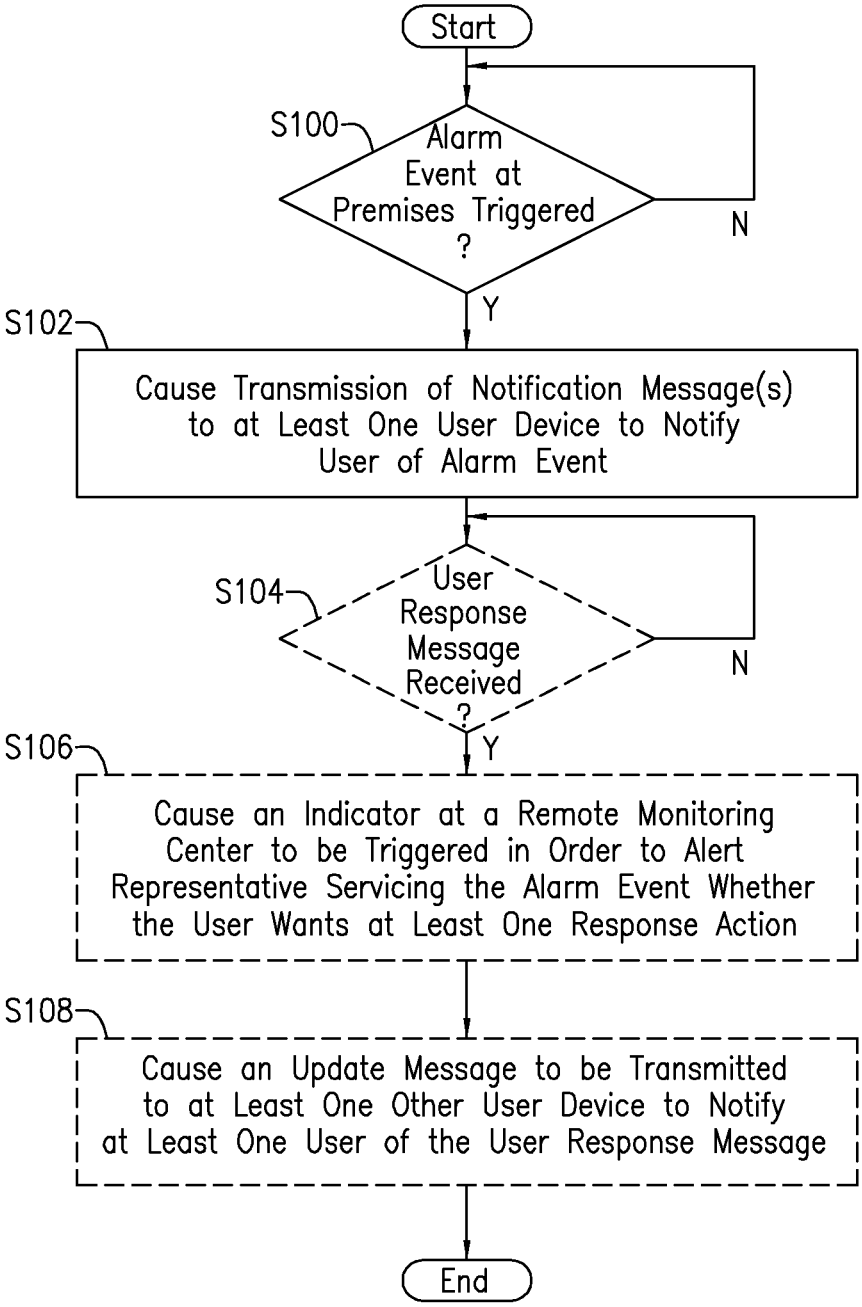
FIG. 5 is a flowchart of an exemplary notification process in accordance with the principles of the invention.
Figure 6:
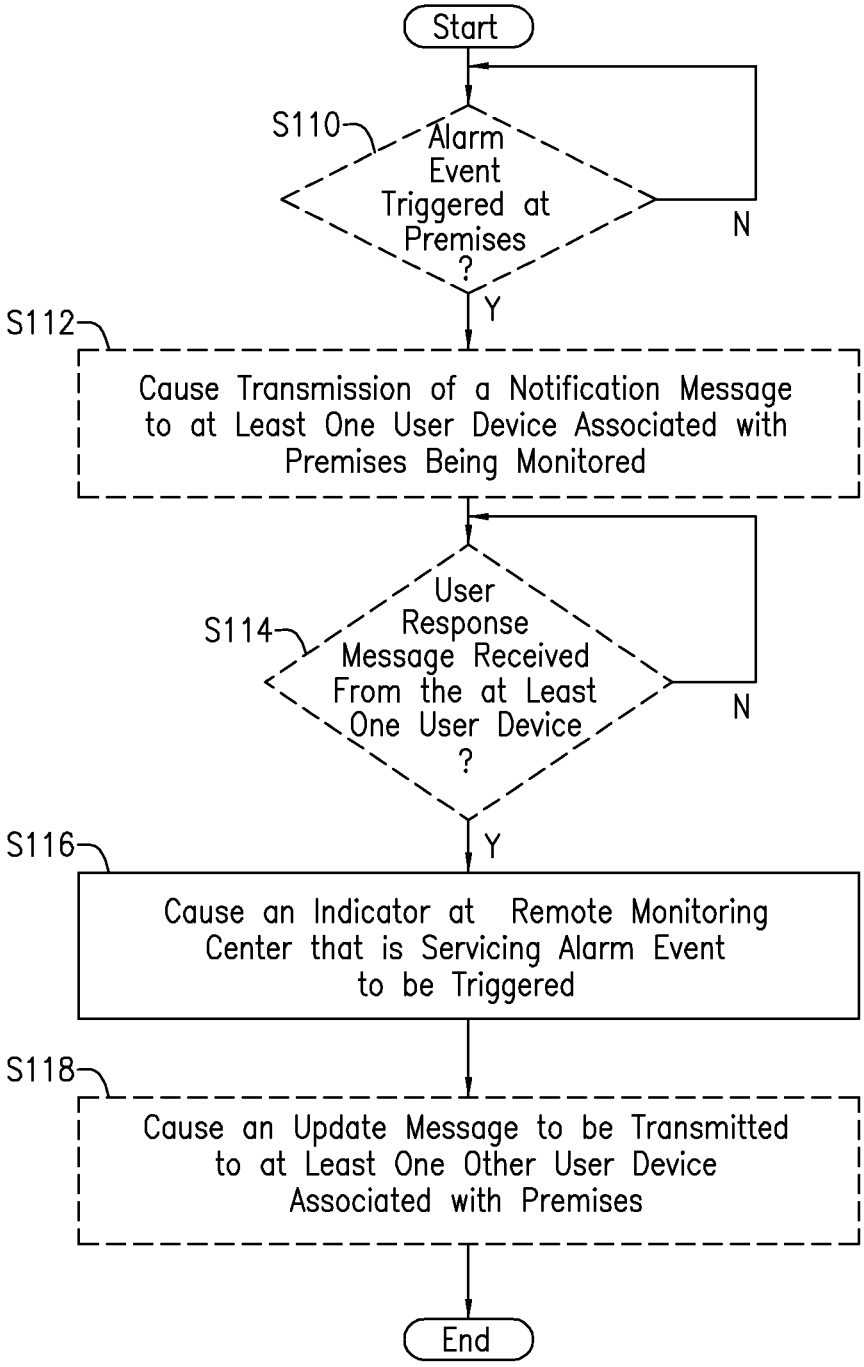
FIG. 6 is a flowchart of an exemplary messaging process in accordance with the principles of the invention.

System 10 includes remote server 20 that performs monitoring, configuration and/or control functions associated with security control unit 18, as discussed in detail with respect to FIGS. 3 and 6. For example, remote server 20 monitors life safety features associated with security control unit 18 in which the remote server 20 receives life safety data from security control unit 18. For example, with respect to fire and carbon monoxide detectors/sensors, life safety data may include at least one carbon monoxide readings, smoke detection reading, sensor location and time of reading, among other related to these detectors that may be communicated with remote server 20. In yet another example, with respect to a door contact detector, life safety data may include at least one of sensor location and time of detection, among other data related to the door contact detection that may be communicated with remote server 20. Remote server 20 may be part of one or more remote monitoring centers 21, and/or may be remote from and in communication with one or more remote monitoring centers 21. Each remote monitoring center 21 may include one or more indicators for notifying or alerting a security company representative of the alarm event and how at least one user associated with a premises being monitored would like the alarm event to be handled, as discussed in detail with respect to FIG. 5-7. In one embodiment, one or both of security control panel 18 and remote server 20 may perform the monitoring of premises 12 for alarm events.

Alarm event data from premises 12 may be used by remote server 20 and remote monitoring center 21 for various life safety response processes such as notifying the owner of the premises and notifying any appropriate response agency (e.g., police, fire, emergency response) as discussed herein. The same or separate remote server 20 and remote monitoring center 21 may also include a life style system/service that allows for various life style features associated with security control unit 18. The remote life style system may receive life style data from security control unit 18. For example, with respect to temperature control, life safety data may include thermostat readings. In yet another example, with respect to video capture devices, life style data may include at least one of captured images, video, time of video capture and video location, among other data related to video capture devices that may be in communication with remote monitoring center 21 and/or remote server 20. Remote monitoring center 21 and/or remote server 20 may also provide updates to security control unit 18 such as updates to features associated with life safety and/or life style operating system. Those of ordinary skill in the art will appreciate that video and other data may also be used by the life safety monitoring center.

Figure 2:
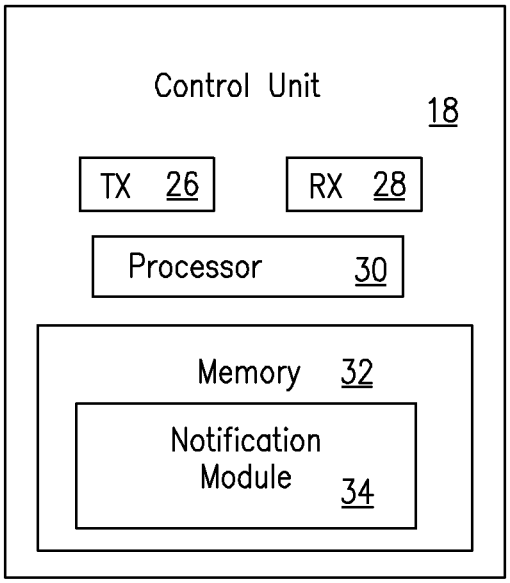
FIG. 2 is a block diagram of a security control unit in accordance with the principles of the invention.

FIG. 2 is a block diagram of security control unit 18. Security control unit 18 includes transmitter 26, receiver 28, memory 32 and processor 36 in communication with each other. Transmitter 26 and receiver 28 are configured to communicate with premises devices 14, interface devices 16, remote server 20, remote monitoring center 21 and user devices 22, either directly and/or via network 24. Transmitter 26 and receiver 28 may be one or more transceivers. Processor 30 may be one or more central processing units (CPUs) that execute computer program instructions stored in memory 32 to perform functions described herein with respect to security control unit 18. Memory 32 includes non-volatile and volatile memory. For example, non-volatile memory may include a hard drive, memory stick, flash memory and the like. Also, volatile memory may include random access memory and others known in the art. Memory 32 may store notification module 34. Notification module 34 includes instructions, which when executed by processor 30, causes processor 30 to perform the processes described herein, such as the notification process, discussed in detail with reference to FIG. 5.

FIG. 3 is a block diagram of remote server 20. Remote server 20 includes transmitter 36, receiver 38, processor 40 and memory 42 in communication with each other. In particular, transmitter 36, receiver 38, processor 40 and memory 42 may generally correspond to the components of security control unit 18, with size and performance being adjusted based on design need, while providing the functionality described herein with respect to remote server 20. For example, transmitter 36 and receiver 38 provide communications with interface device 16, premises device 14, user device 22, security control unit 18 and/or other monitoring centers 21 via network 24 using one or more communication protocols as is known in the art. Remote server 20 may also communicate with other devices and servers at remote monitoring center 21. Memory 42 includes messaging module 44, among other modules and/or data. Messaging module 44 includes program instructions, which when executed by processor 40, cause processor 40 to perform the messaging process, discussed in detail below with respect to FIG. 6.

FIG. 4 illustrates a block diagram of user device 22. User device 22 includes transmitter 46, receiver 48, processor 50 and memory 52 in communication with each other. In particular, transmitter 46, receiver 48, processor 50 and memory 52 may generally correspond to the components of security control unit 18 and/or remote server 20, with size and performance being adjusted based on design need, while providing the functionality described herein with respect to user device 22. For example, transmitter 46 and receiver 48 provide communications to/from security control unit 18, remote server 20 and remote monitoring center 21 via network 24 using one or more communication protocols known in the art. Memory 52 includes alert module 54, among other modules and/or data. For example, alert module 54 includes program instruction, which when executed by processor 50, cause processor 50 to perform the messaging process, discussed in detail below with respect to FIG. 7. Alert module 54 may be a downloadable program application.

A notification process of notification module 34 is illustrated in FIG. 5. Processor 30 determines if an alarm event at premises 12 has been triggered (Block S100). For example, security control unit 18 receives data from one or more premises devices 14 for determining whether a premises device 14 indicates an alarm event such as a sensor that indicates movement. If an alarm event at premises 12 has not been triggered, the determination of Block S100 is repeated, e.g., periodically repeated. In response to determining an alarm event at premises has been triggered, processor 30 causes transmission of a notification message to at least one user device 22 associated with premises 12 being monitored to notify the user of the alarm event (Block S102). The notification message is transmitted to user device 22 from security control unit 18 via network 24. The notification message indicates an alarm event has been triggered and may include the data, time, zone of alarm event corresponding to the tripped premises device 14, image of one or more zones in premises 12, video of one or more zones in premises 12, location of one or more user devices 12 relative to premises 12 as determined by security control unit 18 (e.g., such as via Wi-Fi at premises 12), among other data and/or media related to the premises device 14 having an alarm event.

Processor 30 determines whether a user response message has been received from the at least one user device 22 (Block S104). For example, the user response message indicates the user of the at least one user devices wants at least one response action. The at least one response action may include at least one of verifying the alarm event, cancelling the alarm event and having a responder dispatched to the premises. The user response message may include an authorization code, disarm code and/or other user provided information such as information usable by a responder dispatched to premises 12. If processor 30 determines a user response message has not been received, processor 30 repeats the determination of Block S104, e.g., periodically repeat.

In one embodiment, processor 30 returns to Block S100 after a predetermined amount of time such that a user is given a predetermined amount of time to indicate whether the user wants at least one response action, e.g., verify or cancel the alarm event. This predetermined amount of time included in the notification message to user device 22 may be displayed on display 49 of user device 22. For example, a notification message may indicate to a user, via display 49, that the user has ten minutes (predetermined amount of time) to indicate at least one response action, e.g., cancel or verify the alarm event. In another example, the notification message may indicate that the user has until 3 pm to indicate at least one response action, e.g., verify or cancel the alarm event that was triggered at 2:50 pm.

If processor 30 determines the user response message has been received from the at least one user device 22, processor 30 causes an indicator at remote monitoring center 21 that is serving the alarm event to be triggered in order to alert a representative at remote monitoring center 21 that is monitoring/servicing the alarm (Block S106). For example, security control unit 16 may forward the user response message to remote server 20 and/or remote monitoring center 21, or may transmit a new message indicating user of user device 22 wants to cancel/verify alarm event to remote server 20 and/or remote monitoring center 21. In one embodiment, processor 30 compares the code included in the user response message to one or more codes stored in memory 30 to check if the user of user device 12 is authorized to respond to the notification message. If the code included in the response message matches one or more codes stored in memory 30, processor 30 may perform Block S106. If the code included in the user response message does not match one or more codes stored in memory 30, processor 30 will not cause an indicator at remote monitoring center 21 to be triggered and/or may return to Block S112.

Processor 30 causes an update message to be transmitted via transmitter 26 to at least one other user device 12 associated with premises 12 to notify at least one user of the response message (Block S108). The update message indicates at least one of a plurality of users associated with premises 12 wants to verify or cancel the alarm event. The update message may include an identity the user that wants to the at least one response action, e.g., cancel the alarm event. The update message provides the other users, e.g., mother, son, daughter, etc., information via respective user devices 12 as to which user, e.g., father, wants at least one response action such as to verify or cancel the alarm. The update message may include a message for display by display 49 that the remote monitoring center 21 will attempt to provide the at least one response action, e.g., cancel the alarm event, as requested by specific user device 12, or a message for display by display 49 that remote monitoring center 21 will notify emergency responders about the alarm event. In other words, the update message provides notice to one or more users of user devices 12 associated with premises 12 that remote monitoring center 21 received the response message to cancel/verify the alarm event.

The update message may also be transmitted via transmitter 26 to user device 12 that transmitted the user response message, i.e., to the user that requested the at least one response action such as verification or cancellation of the alarm event. Data of users and/or user devices 12, i.e., contacts, associated or enrolled with security control unit 18 may be stored in memory 32 such that security control unit 18 is able to determine which user devices 22 to contact. In one embodiment, Blocks S106 and S108 may be skipped or omitted. For example, after security control unit 18 transmits the notification message to user device 12, user device 12 may communicate the user response message directly with remote server 20 and/or remote monitoring center 21 via network 24. In another embodiment, discussed below in FIG. 6, one or more of Blocks S100, S102 and S104 may be performed by remote server 20.

Further, a disarm indication or code, i.e., alarm event cancellation, may be received by security control unit 18 from interface device 16 at premises 12. For example, a user at premises 12 may enter a disarm code after the alarm event has been triggered but before notification message(s) have been sent out to one or more user devices 12. In one embodiment, notification messages may still be transmitted by security control unit 18, as described in Block S102, or remote server 20, as described in Block S112, but may include an indication that remote monitoring center 21 will attempt to provide the at least one response action, e.g., cancel the alarm event, among other data. The notification message may still prompt the user of user device 12 to respond to the notification message. In another embodiment, update messages may be transmitted by security control unit 18, as described in Block S108, or remote server 21, as described in Block S118, to one or more user devices 12 associated with premises 12, and may include an indication that remote monitoring center 21 will attempt to provide the at least one response action, e.g., cancel the alarm event, among other data.

In another example, a user at premises 12 may enter a disarm code after the alarm event has been triggered and after notification message(s) have been sent out to one or more user devices 12 associated with premises 12. In one embodiment, notification messages are transmitted by security control unit 18, as described in Block S102, or remote server 20, as described in Block S112, and includes an indication that the remote monitoring center will attempt to provide the at least one response action, e.g., cancel the alarm event, among other data. The notification message may still prompt the user via user device 12 to respond to the notification message. In another embodiment, update messages are transmitted by control unit 18, as described in Block S108, or remote server 21, as described in Block S118, to one or more user devices 12 associated with premises 12, and may include an indication that the remote monitoring center will attempt to cancel the alarm event, among other data.

A messaging process of messaging module 44 is illustrated in FIG. 6. Processor 40 determines whether an alarm event at premises 12 has been triggered (Block S110). For example, remote server 20 may receive alarm data from security control unit 18 that indicates an alarm event has occurred, i.e., determines an alarm event occurred based on alarm data received from security control unit 18. If the determination is made that an alarm event at premises 12 has occurred, processor 40 causes transmission of a notification message to at least one user device 22 associated with premises 12 being monitored (Block S112). The notification message may include the same data and indications as described above with respect to Block S102.

Processor 40 determines whether a user response message has been received from the at least one user device 22 as described with respect to Block S104 but with remote server 20 communicating with user device 12 (Block S114). In response to determining the user response message has been received, processor 40 causes an indicator at a remote monitoring center that is servicing the alarm event to be triggered (Block S116). For example, the indicator may be a pop up message on the computer of a representative at remote monitoring center 21. The pop up message indicates to the representative that that a user associated with premises 12 is requested at least one response action such as verifying the alarm event, requesting the alarm event to be cancelled or having a responder dispatched to premises 12. In one embodiment, the user may indicate the need for processing of the alarm event at remote monitoring center 21 by verifying via the user response message that the alarm event is genuine. For example, the notification message to user device 12 may include an image of the premises zone corresponding to the alarm event in which a fire or a burglar can be seen in the image such that the user of user device 12 may want to not only verify the alarm event but request dispatch of a responder to premises 12. Further, the user of user device 22 may include other data in response message that may help responders, e.g., key under door mat, dog on premises, person in second floor, break-in in back of home, description of suspect(s), image data, video data, etc. The other data in the response message may be forwarded to a device associated with at least one responder.

In one embodiment, processor 40 compares the code included in the user response message to one or more codes stored in memory 42 to make sure the user of user device 12 is authorized to respond to the notification message. If the code included in the response message matches one or more codes stored in memory 42, processor 40 may perform Block S106. If the code included in the response message does not match one or more codes stored in memory 42, processor 40 will not cause an indicator at remote monitoring center 21 to be triggered and/or may return to Block S112. Processor 40 causes an update message to be transmitted to at least one other user device 22 associated with premises 12 as described above with respect to Block S108 (Block S118).

An alert process of alert module 54 is illustrated in FIG. 7. Processor 50 determines whether a notification message has been received (Block S120). If a notification message has not been received, processor 50 may repeat, e.g., periodically repeat, the determination of Block S120. If processor 50 determines the notification message has been received, processor 50 causes the user to be prompted to respond to the message (Block S122). For example, processor 50 causes user device 12 to vibrate, activate a notification light on user device 12 indicating a message is waiting to be read, and/or display the message on display 49 of user device 22. In one embodiment, the notification message may prompt user of user device 12 to respond by indicating at least one response action such as cancelling or verifying an alarm event. Processor 50 determines whether the user of user device 12 has provided a response to the notification message such as by pressing "verify alarm", "cancel alarm" or at least one response action button on display 49. The list of response actions may be predefined based on the triggered alarm event.

If the determination is made that a user response has not been received, processor 50 repeats, e.g. periodically repeats, the determination of Block S124. In one embodiment, processor 50 may "time out" block S124 in which a predetermined time included in the notification message has been reached such that processor 50 returns to the determination of Block S120. In one embodiment, processor 50 may notify user of user device 22 that the predetermined time for responding to the notification message has been reached, and that the user should contact the service representative by phone. If the determination is made that the user response via one or more inputs mechanisms of user device 22 has been received from the user, processor 50 causes a user response message to be transmitted by transmitted 46 (Block S128). In one embodiment, user device 22 may transmit the user response message to remote server 20 and/or remote monitoring center 21 via network 24. In another embodiment, user device 22 may transmit the user response message to security control unit 18 via network 24. The user response message indicates the user of user device 22 wants at least one response action to be performed, e.g., cancel or verify the alarm event triggered at premises 12.

Processor 50 determines an update message has been received (Block S130). The update message indicates at least one of the users associated with premises 12 wants to at least one response action to be performed, e.g., verify or cancel the alarm event. The update message may further include the identity of the user that wants to cancel the alarm event. For example, the update message may indicate the owner of premises 12 or parent of family living at premises 12 wants to cancel the alarm event, i.e., identify person verifying or cancelling alarm event. The update message acts a confirmation to the user of user device 22, who wants alarm cancel or verify, that the instruction to cancel or verify were received by remote monitoring center 21.

In one embodiment, the update message is transmitted to all user devices 22 associated with premises 12, i.e., registered with security control unit 18 at premises 12 such that the other users are notified that at least one user is requesting for the alarm event to be cancelled or verified, i.e., requesting at least one response action. This provides the advantage to other users associated with premises 12 to also respond to the notification in case they agree or disagree with the cancelling or verification of the alarm event. For example, an employee, son or daughter associated with premises 12 may respond to the notification message by indicating he/she wants the alarm cancelled but the owner or parent associated with the premises may want to verify the alarm event out of an abundance of precaution, or may have verified the alarm event to be genuine. As such, the other users may also respond to the notification message. In one embodiment, each user may be granted a different level of authorization such that one user can override another user's verification or cancellation. Alternatively, after the first response to notification message is received, any further responses may be logged by remote server 20 and/or remote monitoring center 21 but not acted on.

In one embodiment, remote server 20 and/or security control panel 18 may be configured to automatically send a cancellation or verification message to one or more dispatch devices associated with one or more dispatch entities, e.g., emergency responders, in response to the response message indicating the user of user device 22 wants to verify or cancel the alarm event. For example, remote server 20 and/or security control panel 18 may search a database, at remote monitoring center 21 or at another location, for the one or more dispatch entities, e.g., police, firefighters, police dispatcher, etc., that was alerted and is responding to the alarm event. If the one or more dispatch entities are found in the database, remote server 20 and/or security control unit 18 transmits a cancellation message to the one or more dispatch entities via network 24. The cancellation message may be in the form of a text message, email, automatically dialed telephone call and/or other electronic form known in the art. Further, the cancellation message may include data that may be useful to the one or more dispatch entities. For example, the cancellation message may include data from the response message such as the identity of the user that verified or cancelled the alarm event and/or data provided by the user of user device 22 that may be useful for the one or more dispatch entities in case of an emergency, e.g., key under door mat, dog at premises, person in second floor, break-in in back of home, description of suspect(s), etc. While the cancellation message allows a user to control the response process initiated by the alarm event, the cancellation message does control the system itself, i.e., does not disarm or arm security control panel 18.

Figure 8:
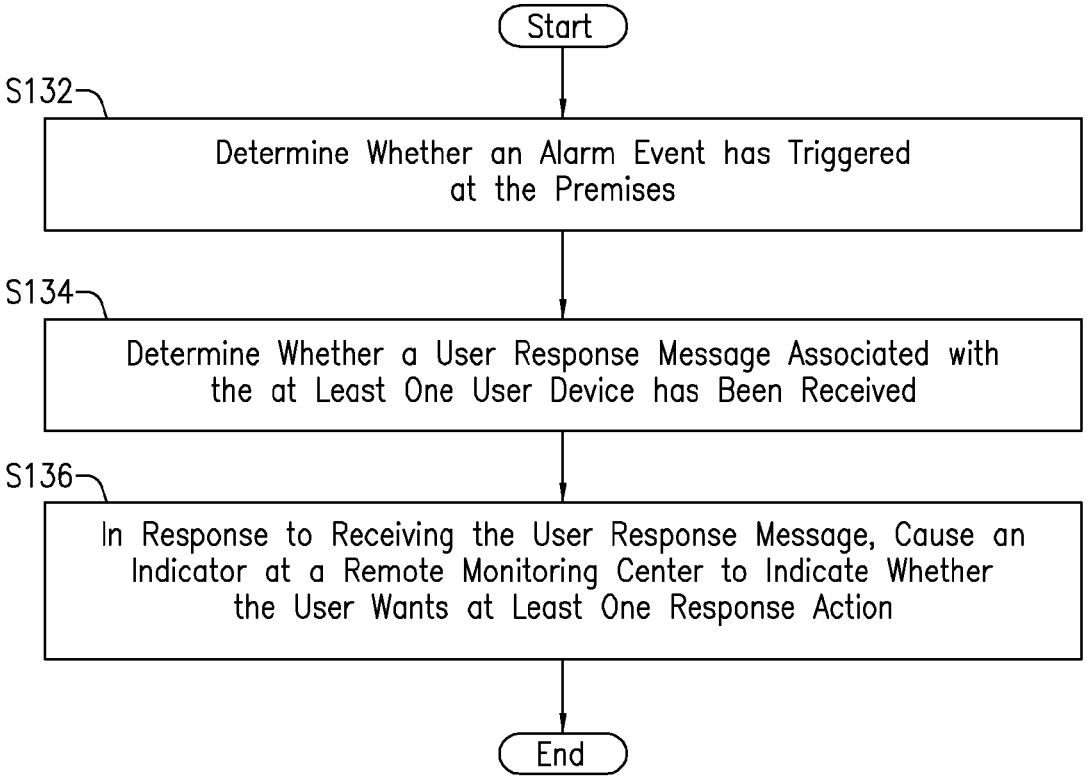
FIG. 8 is a flowchart of an exemplary alternative messaging process in accordance with the principles of the invention.

An alternative messaging process of messaging module 54 is illustrated in FIG. 8. Processor 40 is configured to determine whether an alarm event has triggered at premises 12 (Block S132). Processor 40 is configured to determine whether a user response message associated with the at least one user device has been received (Block S134). The user response message indicates the user of the at least one user device wants to one of verify the alarm event and cancel the alarm event. Processor 40 is configured to, in response to receiving the user response message, cause an indicator at a remote monitoring center that is servicing the alarm event to be triggered to indicate whether the user wants at least one response action (Block S136). The triggered indicator indicates that the user wants at least one response action such as to verify the alarm event, cancel the alarm event, verify the alarm event or have a responder dispatched to the premises. In one embodiment, neither the user response message nor the triggered indicator are able to directly change the state of the alarm system from the armed state to a disarmed state. In other words, the user response message and the trigger indicator are used to indicate to the monitoring center or emergency dispatch service that the users wishes at least one response action to be performed, e.g., verify alarm as genuine or cancel alarm, but the response message and triggered indicator are not able to change the state of the security system from armed to disarmed, or vice versa. The user is allowed direct control over the response process initiated by the alarm event.

Therefore, the instant invention advantageously provides notification messages to one or more user devices 12 associated with premises 12 such that one or more users of user devices 12 can request at least one response action, e.g., verify or cancel alarm event processing at remote monitoring center 21 via text message, email or other forms of electronic communication. A user with direct control of the response process to an alarm event as opposed to the system itself. In one embodiment, the instant invention's messaging and triggered indicator at remote monitoring center 21 do not alter the alarm system state at premises 12 such that the messaging among remote server 20, user device 22 and/or security control unit 18 does not change the alarm system state from "armed" to "disarm", i.e., does not turn off the alarm system at premises 12. While system 10 is described with reference to security, the invention is not limited to such and is applicable to home automation system related events. Further, in one embodiment, processing functions described herein are performed at remoter server 20 or remote monitoring center, while alarm monitoring functions described herein are performed at premises 12 by control unit 18.

While the modules described herein are discussed as being software stored in memory, the modules may be hardware based or software-hardware based. Further, separate programs can be a single program.

It will be appreciated by persons skilled in the art that the invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A system for managing response to an alarm event for an alarm system monitoring a premises, the premises being associated with at least one user device, the system comprising:

a monitoring device including a processor programmed to:

determine whether an alarm event has triggered at the premises;

determine whether a user response message associated with the at least one user device has been received; and in response to receiving the user response message:

cause an indicator at a remote monitoring center to indicate whether the user wants at least one response action; and cause transmission of an update message to at least one other user device associated with the premises, the update message indicating whether or not at least one of a plurality of users associated with the premises wants the response action, the update message including the identity of the user that wants the response action.

2. The system of claim 1, wherein the at least one response action includes one of verifying the alarm event, cancelling the alarm event and having a responder dispatched to the premises.

3. The system of claim 1, wherein the processor is further programmed to, in response to determining the alarm event has triggered, cause transmission of a notification message to the at least one user device associated with the premises being monitored, the notification message indicating the alarm event has been triggered.

4. The system of claim 3, wherein the notification message includes alarm event information.

5. The system of claim 1, wherein the user response message includes user provided information for a responder dispatched to the premises, the user provided information being associated with the alarm event.

6. The system of claim 1, wherein if the user response message indicates the user wants a responder dispatched to the premises, the user response message further indicating whether the user has verified the alarm event is genuine.

7. The system of claim 1, further comprising a security control unit at the premises configured to:

determine whether the alarm event has triggered at the premises; and in response determining the alarm event has triggered, cause transmission of a notification message to the at least one user device, the notification message indicating the alarm event has been triggered.

8. The system of claim 7, wherein the security control unit is further configured to:

determine whether the user response message has been received from the at least one user device;

in response to receiving the response message, forwarding the response message to a remote server.

9. The system of claim 8, wherein the security control unit is further configured to cause transmission of an update message to at least one other user device, the update message identifying the user of the at least one user device that wants the response action.

10. A method for managing response to an alarm event for an alarm system monitoring a premises, the method comprising:

determining whether an alarm event has triggered at the premises;

determining whether a user response message from the at least one user device has been received; and in response to receiving the user response message:

causing an indicator at a remote monitoring center to indicate whether the user wants at least one response action; and causing transmission of an update message to at least one other user device associated with the premises, the update message indicating whether or not at least one of a plurality of users associated with the premises wants the response action, the update message including the identity of the user that wants to cancel the response action.

11. The method of claim 10, wherein the at least one response action includes at least one of verifying the alarm event, cancelling the alarm event and having a responder dispatched to the premises.

12. The method of claim 10, further comprising:

determining whether the alarm event has triggered at the premises; and in response to determining the alarm event has triggered, causing transmission of a notification message to the at least one user device associated with the premises being monitored, the notification message indicating the alarm event has been triggered.

13. The method of claim 10, further comprising transmitting a cancellation message to a dispatch device associated with at least one dispatcher that is responding to the alarm event.

14. The method of claim 10, wherein if the user response message indicates the user wants a responder dispatched to the premises, the user response message further indicating whether the user has verified the alarm event is genuine.

15. The method of claim 10, further comprising causing transmission of an update message to at least one other user device, the update message identifying the user of the at least one user device that wants to one of verify and cancel the response action.

16. The method of claim 10, wherein the user response message includes user provided information for a responder dispatched to the premises, the user provided information being associated with the alarm event.

17. A server for managing response to an alarm event for an alarm system monitoring a premises, the server being associated with a remote monitoring center, the server comprising:

a processor programmed to:

determine whether the alarm event has triggered at the premises; and in response to determining the alarm event has triggered, cause transmission of a notification message to the at least one user device associated with the premises being monitored, the notification message indicating the alarm event has been triggered;

determine whether a user response message from the at least one user device has been received, the user response message indicating the user of the at least one user device wants at least one response action; and in response to receiving the user response message;

cause an indicator at a remote monitoring center that is servicing the alarm event to be triggered, the triggered indicator indicating whether the user wants at least one response action; and cause transmission of an update message to at least one other user device associated with the premises, the update message indicating whether or not at least one of a plurality of users associated with the premises wants the response action, the update message including the identity of the user that wants the response action.

18. The server of claim 17, wherein if the user response message indicates the user wants to a responder dispatched to the premises, the user response message further indicating whether the user has verified the alarm event is genuine.

19. The server of claim 17, wherein the at least one response action includes at least one of verifying the alarm event, cancelling the alarm event and having a responder dispatched to the premises.

20. The server of claim 17, wherein the user response message includes user provided information for a responder dispatched to the premises, the user provided information being associated with the alarm event.

* * * * *